US006848206B2

(12) United States Patent
Zhao

(10) Patent No.: US 6,848,206 B2
(45) Date of Patent: Feb. 1, 2005

(54) ORNAMENT HAVING LIQUID THEREIN

(76) Inventor: Jianliang Zhao, Dongkeng Industrial Zone, Gongming Town, Shenzhen (CN)

( * ) Notice: Subject to any disclaimer, the term of this patent is extended or adjusted under 35 U.S.C. 154(b) by 12 days.

(21) Appl. No.: 10/192,204

(22) Filed: Jul. 10, 2002

(65) Prior Publication Data

US 2003/0014889 A1 Jan. 23, 2003

(30) Foreign Application Priority Data

Jul. 17, 2001 (CN) ..... 01230575 U
Jul. 17, 2001 (CN) ..... 01230576 U

(51) Int. Cl.[7] ..... G09F 19/00
(52) U.S. Cl. ..... 40/406; 40/409; 40/426
(58) Field of Search ..... 40/406, 409, 410, 40/426; 446/267

(56) References Cited

U.S. PATENT DOCUMENTS 4,852,283 A * 8/1989 Teng ..... 40/426
5,165,778 A * 11/1992 Matthias et al. ..... 362/101
5,967,088 A * 10/1999 Lin ..... 119/269
6,039,453 A * 3/2000 Wang ..... 362/101
6,061,937 A * 5/2000 Meng ..... 40/409
6,161,317 A * 12/2000 Wang ..... 40/406
6,481,128 B1 * 11/2002 Lin ..... 40/406

* cited by examiner

*Primary Examiner*—Brian K. Green
(74) *Attorney, Agent, or Firm*—Lackenbach Siegel, LLP

(57) ABSTRACT

There is provided an ornament having liquid therein. The liquid in the device is effectively insulated from the electronic and mechanical structures, and the outside air can not enter into the liquid to cause the liquid to deteriorate or become cloudy, and the liquid in the container can not penetrate into the electronic and mechanical structures in the base to result in electrical and mechanical failures. Furthermore, the provision of the buffer members ensures that no crack will occur in the joint between the enclosure and the base body in cold or hot environment. The enclosure may be optionally transparent or opaque and thus the light source for decoration purposes may be provided in the liquid or in the base as needed.

11 Claims, 6 Drawing Sheets

ORNAMENT HAVING LIQUID THEREIN

FIELD OF THE INVENTION

The present invention relates generally to an ornament having liquid therein, and more specifically to an ornament having liquid therein, which is provided with sealing means and can effect water circulation, drawing and jelling.

DESCRIPTION OF THE PRIOR ART

An ornament having liquid therein is made by filling a sealed container with liquid and placing ornamentals, such as various drifting or suspending sheet-like or particle-like ornamentals or artificial flower, grass, worm and fish, into the liquid. To make the ornament more attractive, the sealed container having liquid and ornamentals therein is often combined with various electronic and mechanical means which make the ornamentals drifting and the liquid circulating in the container.

To make the liquid flow in the container, a motor is generally provided in the container so that the liquid in the container is agitated by the power produced by the motor. Under this design, the motor is always immerged in the liquid. A waterproof enclosure may be used to enclose the motor, but the enclosure can function only a short time, because the material of the waterproof enclosure itself or the sealing material in the joint between the enclosure and the container will be aging and deteriorating due to always immerged in the liquid, resulting in the liquid penetrating into the motor and thus short-circuit or failure. Furthermore, the grease or the machine oil applied to the rotor of the motor may enter into the liquid, deteriorating the decorative effect of the device.

A solution to this problem is disclosed in Chinese patent ZL98223047.8, wherein, as shown in FIGS. 1 and 2, a sealed container 4 of the ornament having liquid therein is fitted in a base 1, in which there provided a driving system 3. A rubber cover 2 is provided between the base 1 and the container 4. A protective enclosure 5 passing through an opening 6 in the cover 2 encloses the motor 3 and thus insulate the motor 3 from the liquid in the container. Each of the rotating member 7 which is fitted over the output shaft of the motor 3 and the water-agitating member 8 which is provided on the protective enclosure 5 includes a magnet attracting each other. Thus, the operation of the motor makes the liquid flow in the sealed container. Although this design of the device can insulate the motor from the liquid, it can not avoid liquid leakage because of the opening 6 for passing through the protective enclosure in the cover 2 which is contacted directly with the liquid. Furthermore, the cover is made of rubber material, but the liquid in the container during cold days may freeze and thus expand. In this case, cracks may occur in the joint between the cover and the base, resulting in liquid leakage and decrease in usefulness of the device. It is possible to make the liquid in the container flow and thus various ornamentals drift and swim in the liquid by operating a switch, but one of the drawbacks is that the flowing direction is random, and the decorative effect is relatively monotonic.

SUMMARY OF THE INVENTION

An object of the invention is to provide an ornament having liquid therein which can overcome the shortages of the prior art, including a sealing means which can isolate the liquid in the container from the outer environment and the electronic and mechanical means for creating decorative effects and can avoid pollution by the grease or oil and deformation by expansion.

Another object of the invention is to provide an ornament having a liquid therein, including means for effecting water circulation, drawing and jetting, which comprises a cover. The cover not only can make the water circulate, but also can make the ornamentals drift in random directions and produce air bubbles in the liquid by drawing and jetting water and thus increase the decorative effect.

The above objects are achieved by providing an ornament having a liquid therein, including:

- a container for containing and sealing the liquid;
- a base for receiving the electronic and mechanical means for creating the decorative effects; including:
  - a bottom plate for supporting said electronic and mechanical means and closing said base; and
  - a base body, which is consisted of a frustum-conical lower part, from which extends upward a collar, the base body and the bottom plate define a chamber, said collar is fitted over a container wall part at the opening of the container, wherein said ornament further includes:
    - an enclosure which is fitted in said wall part, including:
      - a disc, including a plurality of buffer members which are formed integrally with the disc by molding;
      - a flange which is formed integrally around the disk by molding and is fitted in the container.

Said ornament having a liquid therein, wherein on the flange of the enclosure is provided a circular bulge which is received in a circular groove on the container.

Said ornament having a liquid therein, wherein a recess is integrally formed within the enclosure at the side facing the base between the disc and the flange, in which there is an elastic split ring for increasing the elasticity of said enclosure and preventing said enclosure from deforming when it is pressed.

Said ornament having a liquid therein, wherein a central protective barrel is integrally formed with the disc of the enclosure by molding, in which a motor is provided in said protective barrel and a rotating member is provided on said motor.

Said ornament having a liquid therein, wherein on said barrel is a supporting disc, from which extends upward a central cylinder in which fixes a central shaft and a water-agitating member is rotatably fit over the shaft; each of the rotating member and the water-agitating member has a magnet attracting or repelling each other, so that said rotating member rotates when the motor operates and in turn drives the water-agitating member to rotate.

Said ornament having a liquid therein, further including a cover on the cylinder, said cover includes an inlet and an outlet for drawing and jelling water respectively.

Said ornament having a liquid therein, wherein in the base there provided power source and ICs for providing and controlling the decorative effects.

Said ornament having a liquid therein, wherein on each side of the enclosure disc there provided two completely enclosed metal terminals for electrically connecting with the power source and the light source.

Said ornament having a liquid therein, wherein said light source is provided in the liquid of the container.

Said ornament having a liquid therein, wherein said enclosure is made of transparent material.

Said ornament having a liquid therein, wherein said light source is provided in the base.

Said ornament having a liquid therein, wherein, said enclosure is made of rubber material by molding.

According to the invention, the liquid in the device is effectively insulated from the electronic and mechanical means and the outside air can not enter into the liquid to cause the liquid deteriorating and cloudy and the liquid in the container can not penetrate into the electronic and mechanical means in the base to result in electrical and mechanical failures. Furthermore, the provision of the buffer members ensures that no crack will occur in the joint between the enclosure and the base body in cold or hot environment. The enclosure of the invention can be transparent or opaque and thus the light source for decoration purpose can be provided in the liquid or in the base as needed.

DETAILED DESCRIPTION OF THE PREFERRED EMBODIMENT

Figure 1:
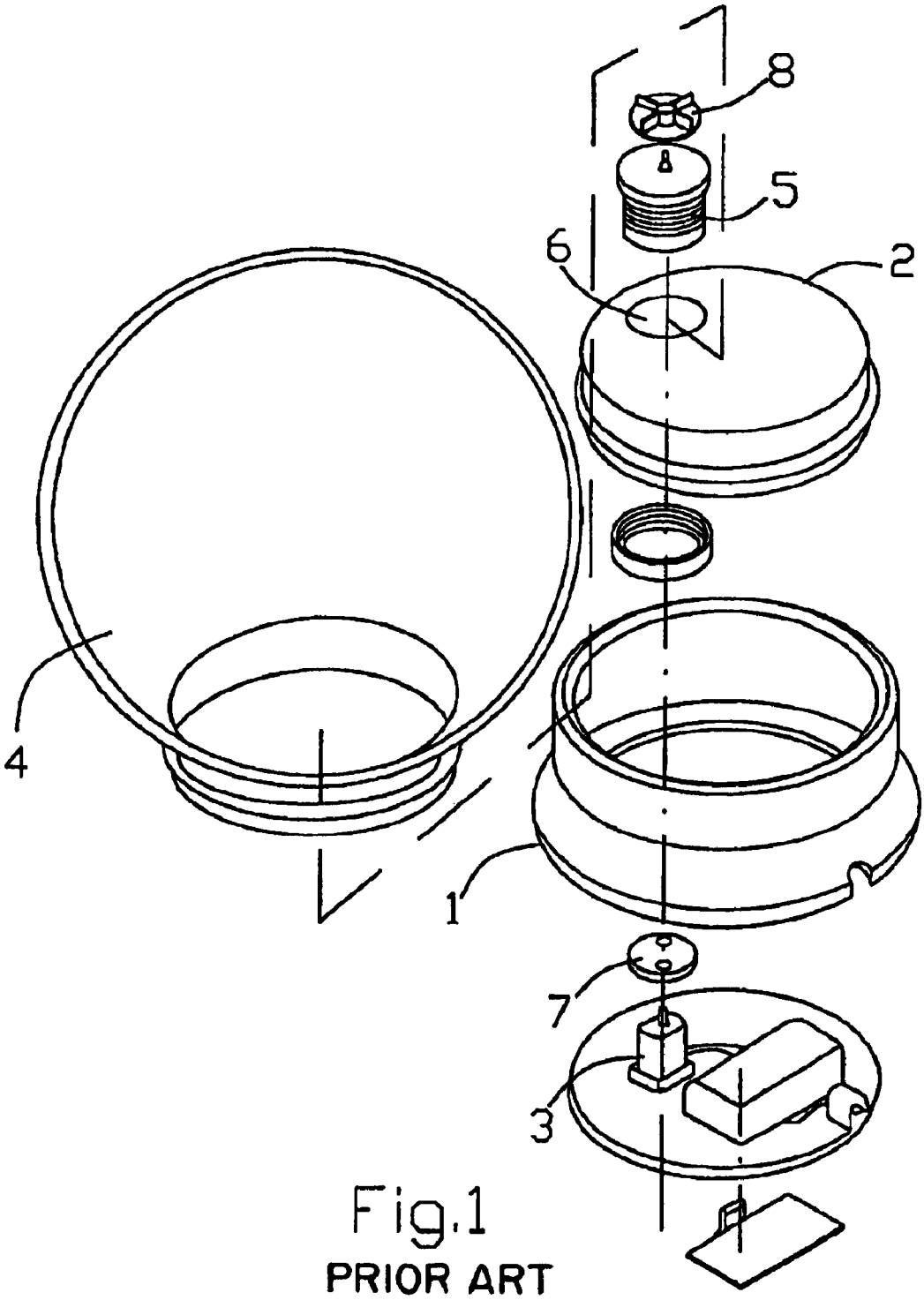
Fig.1 PRIOR ART
FIG. 1 is an exploded perspective view of a conventional prior art ornament.
Figure 2:
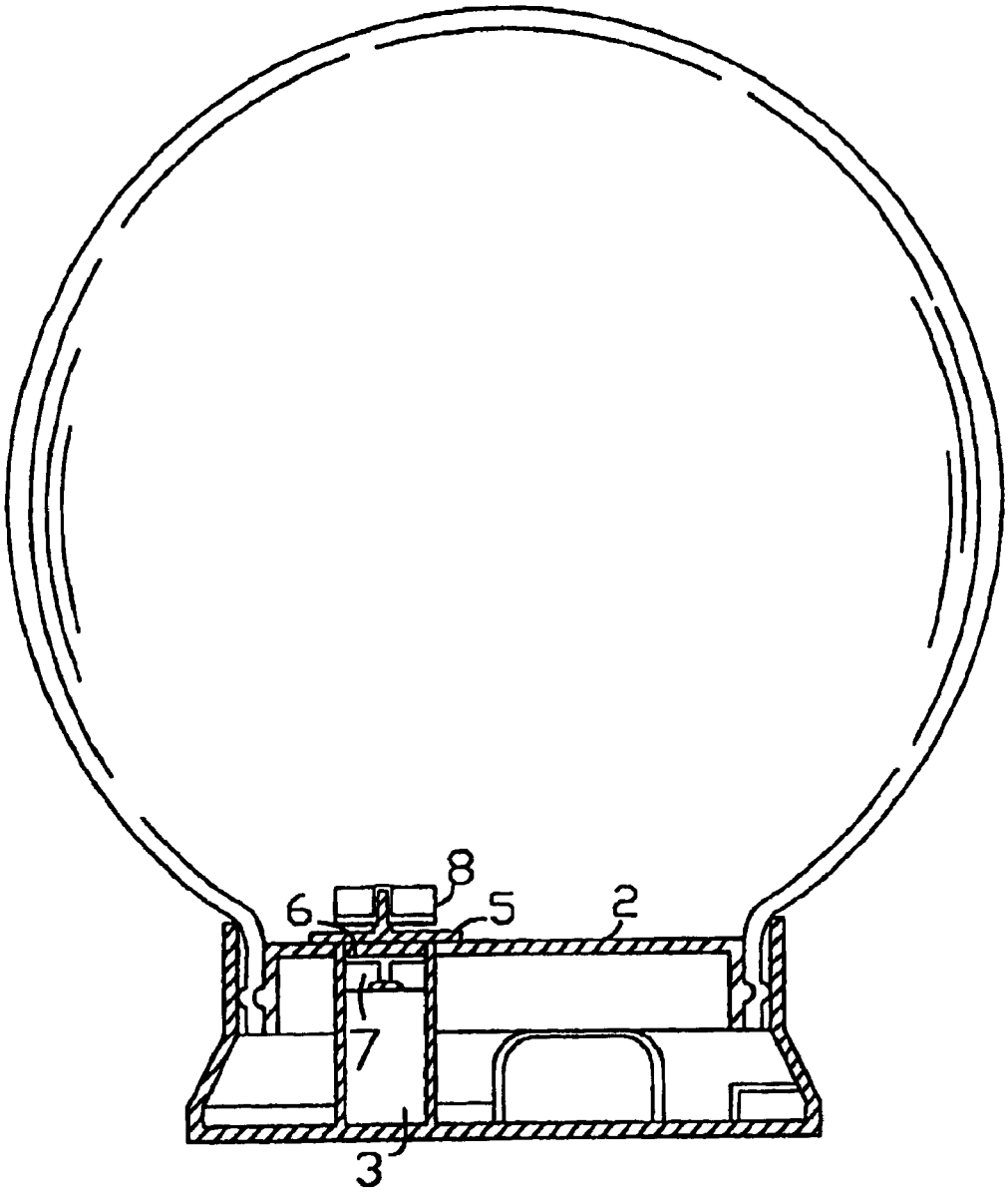
Fig.2 PRIOR ART
FIG. 2 is a sectional view of the conventional prior art ornament of FIG. 1.
Figure 3:
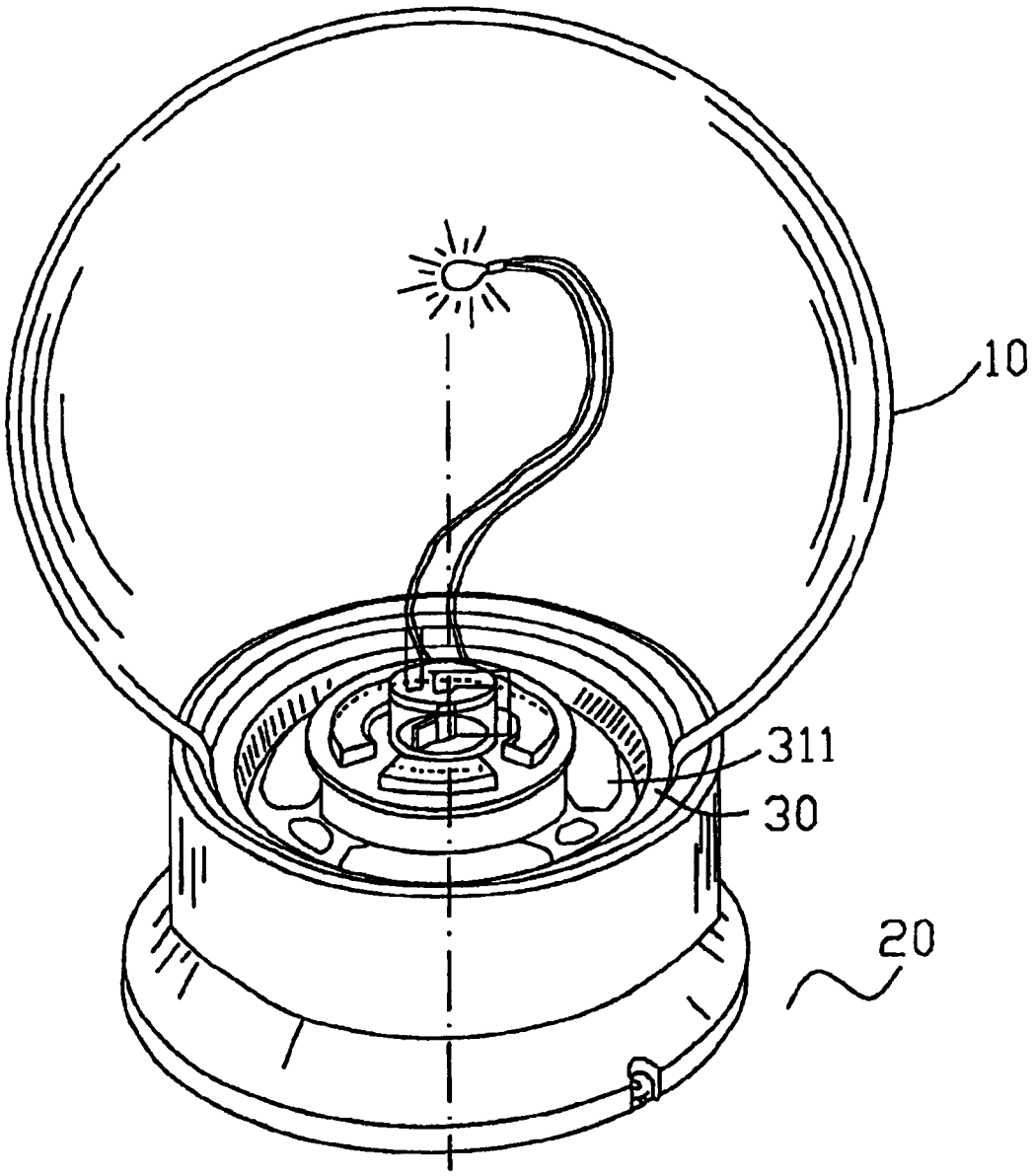
FIG. 3 is a schematic perspective view of an embodiment of the invention.
Figure 4:
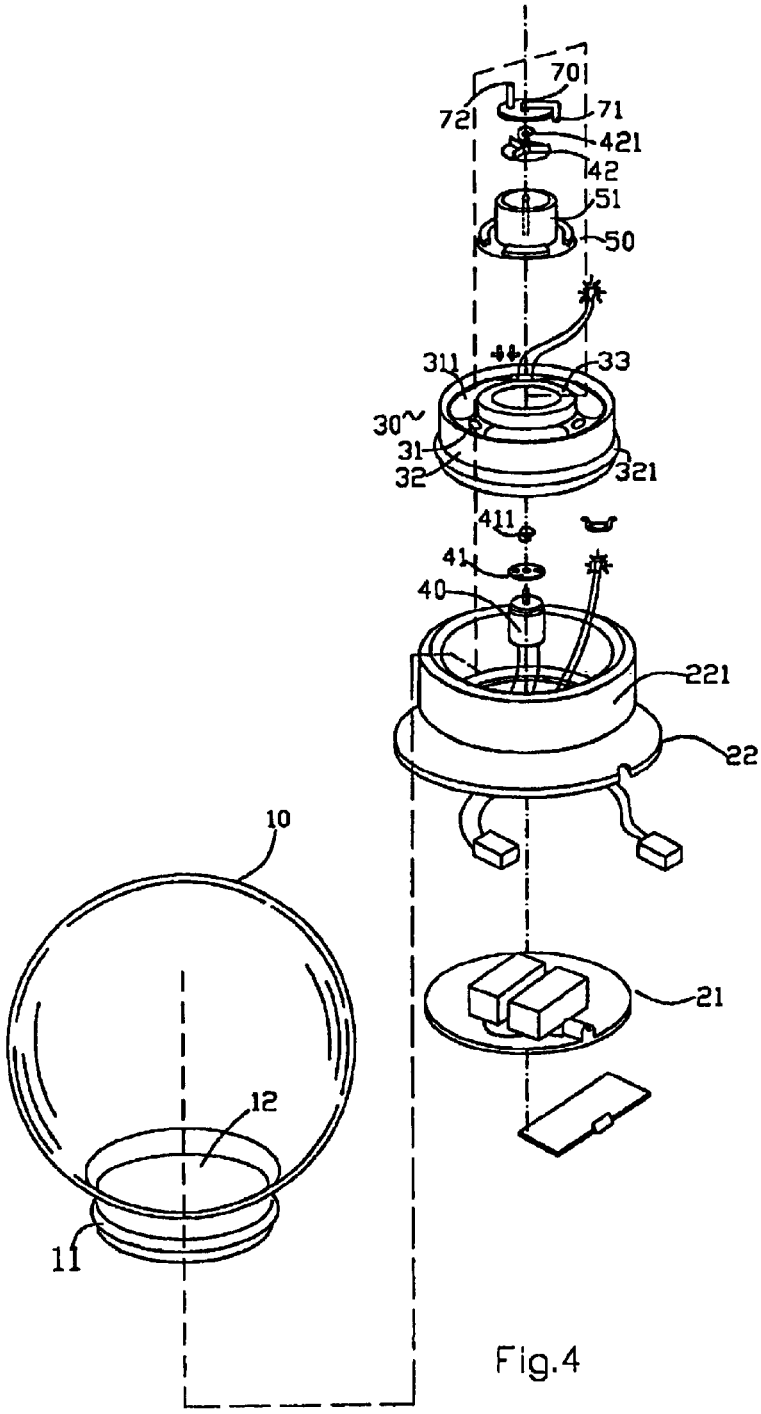
FIG. 4 is an exploded perspective view of the embodiment shown in FIG. 3.
Figure 4A:
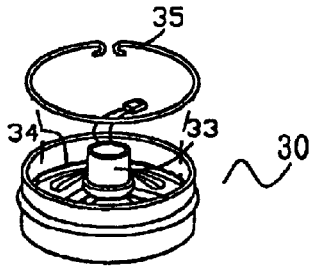
FIG. 4A is an exploded detail view of an enclosure for the invention shown in FIG. 3.
Figure 5:
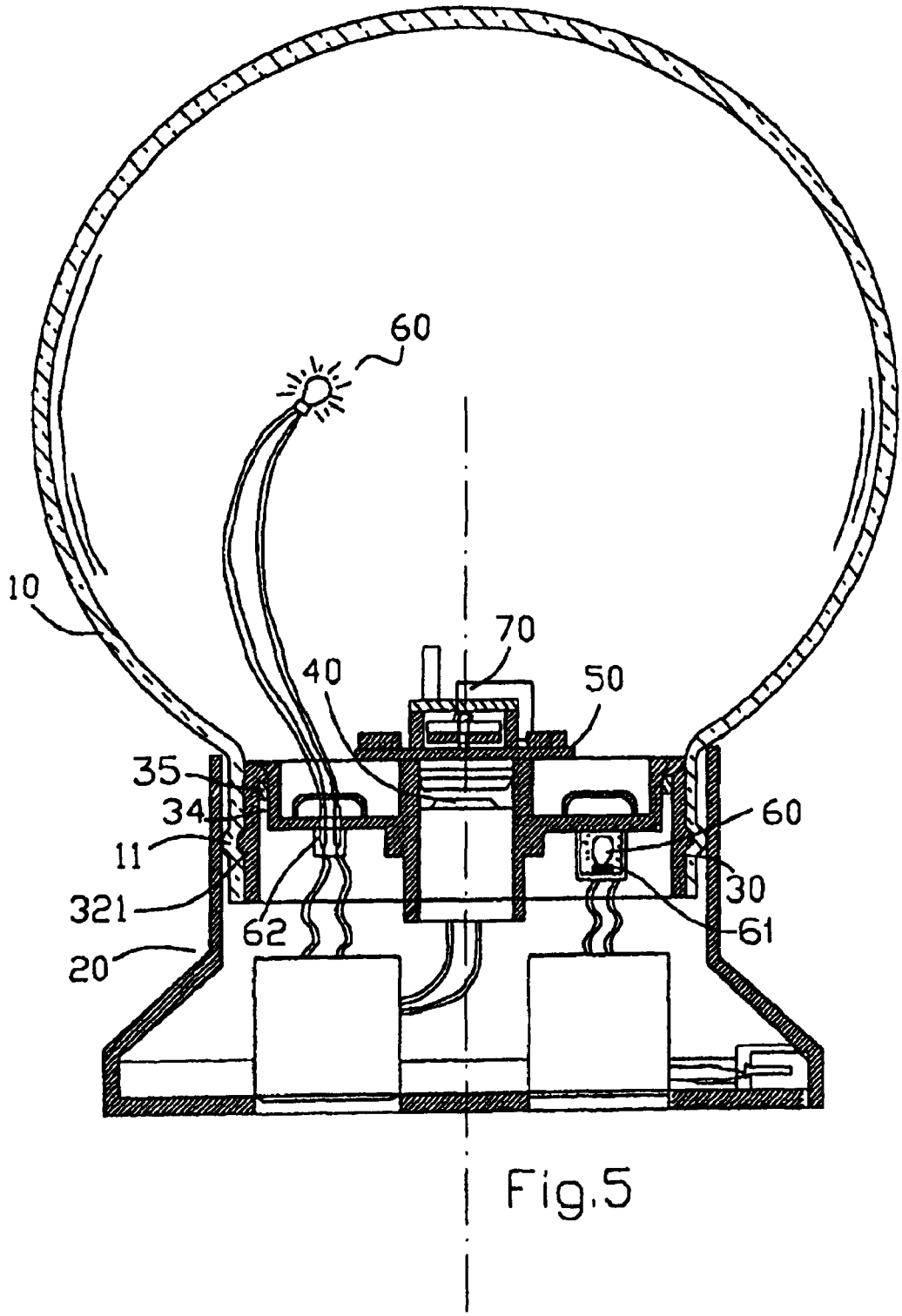
FIG. 5 is a sectional view of the invention.

As shown in FIGS. 3 and 4, an ornament having a liquid therein (crystal-like ball) according to a preferred embodiment of the invention includes a container 10 and a base 20. The container 10 is used for containing the liquid in which can place various ornamentals and has an opening 12. The base 20 is consisted of a bottom plate 21 and a base body 22 having a collar 221 extending upward. The power source and ICs (integrated circuits) for providing the decorative effects, such as music IC, IC for controlling the light intensity, etc., are provided in a chamber which is defined by the base body 22 and the bottom plate 21 and are supported on the bottom plate 21. Said collar 221 is fitted over the container wall part at the opening 12. An enclosure 30 is received in the container 10 at the opening 12. The enclosure 30 is made of rubber material by molding and includes a an disk 31 and a flange 32 around the disc. The disc 31 includes several, preferably 3 or 4 buffer member 311 in the form of convex or concave for preventing the enclosure from deforming when the liquid in the container expands. The flange 32 is fitted in the container wall part at the opening 12. As shown in FIG. 5, on the outer surface of the flange 32 there provided a circular bulge 321, which is received in a circular groove 11 on the container wall part at the opening 12, so that the enclosure 30 is more securely fitted in the container 10.

Figure 6:
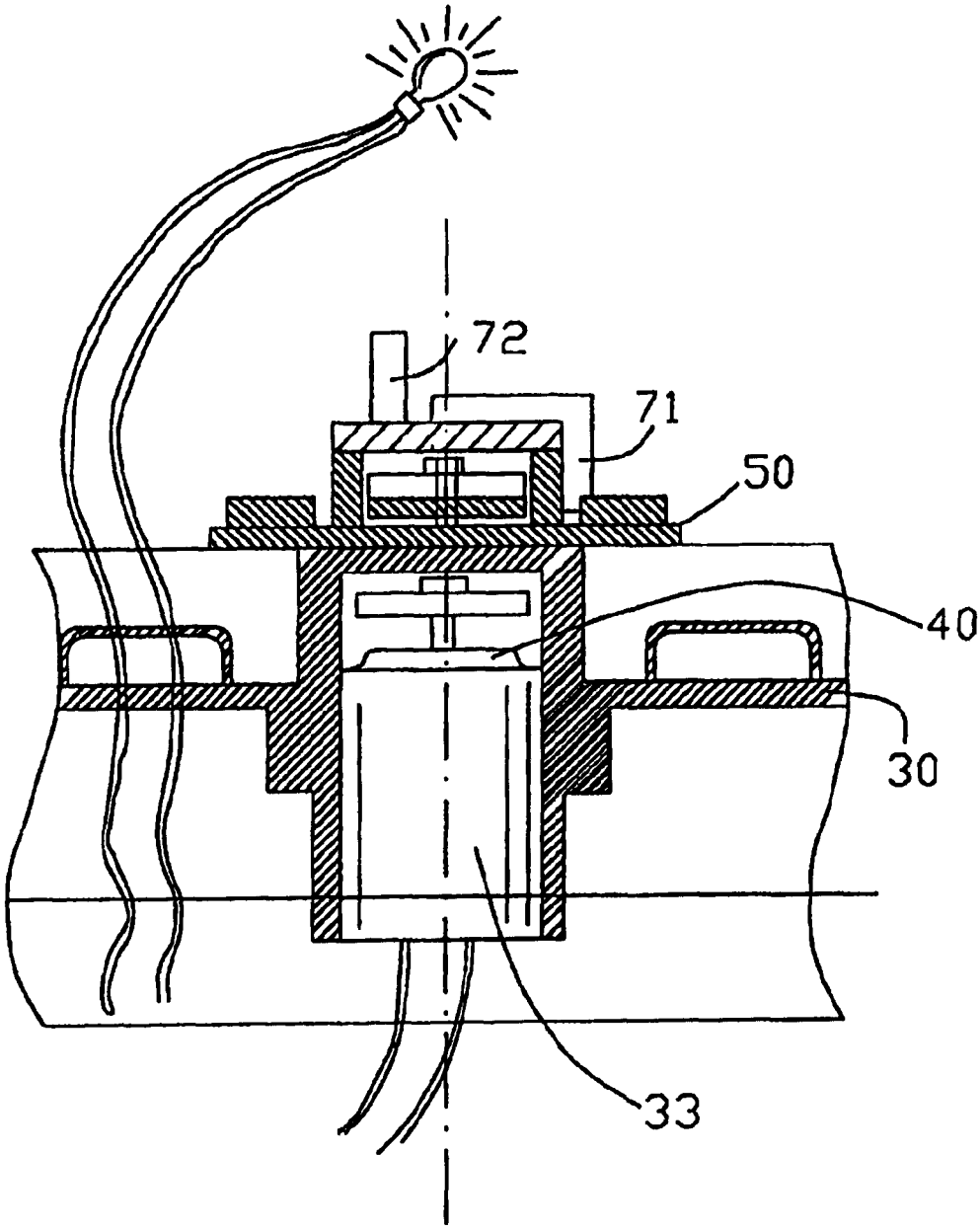
FIG. 6 is an enlarged partial view of the base of the invention shown in FIG. 5.

According to the invention, the disc 31 preferably has a central protective barrel 33 which is formed integrally with the disc by molding. As shown in FIG. 6, the mechanical means such as a motor can be provided in the protective barrel 33. A recess 34 is formed integrally by molding at the side facing the base 20 between the disc 31 and the flange 32. According to the invention, in order to prevent the enclosure 30 from deforming when the flange is too long or it is pressed, an elastic split ring 35 is received in the recess 34 to effectively increase the elasticity of the enclosure 30 and prevent the enclosure 30 from deforming.

In order to make the liquid in the container flow, a rotating member 41 is provided on the motor 40 and on the enclosure 30 a supporting disc 50 is set, from which extends upward a central cylinder 51, in which fixes a shaft and a water-agitating member 42 is rotatably fit over the shaft. Each of the rotating member 41 and the water-agitating member 42 has a magnet 411 and 421, preferably permanent magnet, which have the same specific weight and attract or repel each other, so that when the motor 40 drives the rotating member 41 and the magnet 411 to rotate, the water-agitating member 42 is driven by magnet 421 to rotate and thus make the liquid flow.

On the cylinder 51 there provided a cover 70, which has an inlet 71 and a outlet 72, which draws and jets water respectively when the water-agitating member 42 rotates so as to produce air bubble or water bubble in the liquid.

In order to provide light source 60 in the liquid of the container, on each side of the enclosure disc 31 there provided two completely enclosed metal terminals 61 and 62 for electrically connecting the power source and light source which may be lamps or other light-emitting means such as optron.

According to the invention, the enclosure may be made of transparent material. In this case, as shown in the right half part in FIG. 5, the light source may be provided in the base 20 and thus the light may be radiate into the liquid through the enclosure and can achieve special decorative effect.

It is appreciated from above detailed description that using the construction of the invention the liquid can be effectively insulated from the electronic and mechanical means, and thus the ornament can have more attractive decorative effects.

The invention is not limited to above embodiments, various changes and modifications can be made by the skilled in the art within the spirit and scope of the invention.

What is claimed is:

1. An ornament having a liquid therein, including:

a container (10) for containing and sealing the liquid;

a base (20) for receiving an electronic and mechanical means for creating a decorative effect; including:

a bottom plate (21) for supporting said electronic and mechanical means and closing said base; and a base body (22), which includes a frustum-conical lower part, from which extends upward a collar (221), the base body (22) and the bottom plate (21) define a chamber, said collar (221) is fitted over a container wall part at an opening (12) of the container (10), wherein said ornament further includes:

an enclosure (30) which is fitted in said wall part, including:

a disc (31), including a plurality of buffer members (311) which are formed integrally with the disc (31) by molding;

a flange (32) which is formed integrally around the disk (31) by molding and is fitted in the container (10), wherein a central protective barrel (33) is integrally formed with the disc (31) of the enclosure by molding, in which a motor (40) is provided in said protective barrel (33) and a rotating member (41) is provided on said motor (40) and wherein a recess (34) is integrally formed within the enclosure (30) at a side facing the base (20) between the disc (31) and the flange (32), in which there is an elastic split ring (35) for increasing the elasticity of said enclosure and preventing said enclosure from deforming when it is pressed.

2. An ornament having a liquid therein, including:

a container (10) for containing and sealing the liquid;

a base (20) for receiving an electronic and mechanical means for creating a decorative effect; including:

a bottom plate (21) for supporting said electronic and mechanical means and closing said base; and a base body (22), which includes a frustum-conical lower part, from which extends upward a collar (221), the base (22) and the bottom plate (21) define a chamber, said collar (221) is fitted over a container wall part at an opening (12) of the container (10), wherein said ornament further includes:

an enclosure (30) which is fitted in said wall part, including:

a disc (31), including a plurality of buffer members (311) which are formed integrally with the disc (31) by molding;

a flange (32) which is formed integrally around the disk (31) by molding and is fitted in the container (10), wherein a central protective barrel (33) is integrally formed with the disc (31) of the enclosure by molding, in which a motor (40) is provided in said protective barrel (33) and a rotating member (41) is provided on said motor (40);

wherein on said barrel (33) is a supporting disc (50), from which extends upward a central cylinder (51) which fixes a central shaft and a water-agitating member (42) is rotatably fit over the shaft; each of the rotating member (41) and the water-agitating member (42) has a magnet (411, 421) attracting or repelling each other, so that said rotating member (41) rotates when the motor (40) operates and in turn drives the water-agitating member (42) to rotate; and a cover (70) on the cylinder (51), said cover (70) includes an inlet (71) and an outlet (72) for drawing and jetting water respectively.

3. An ornament having a liquid therein, including:

a container (10) for containing and sealing the liquid;

a base (20) for receiving an electronic and mechanical means for creating a decorative effect; including:

a bottom plate (21) for supporting the electronic and mechanical means and closing the base; and a base body (22), which includes a frustum-conical lower part, from which extends upward a collar (221), the base body (22) and the bottom plate (21) define a chamber, the collar (221) is fitted over a container wall part at an opening (12) of the container (10), wherein the ornament further includes:

an enclosure (30) which is fitted in the wall part, including:

a disk (31), including a plurality of buffer members (311) which are formed integrally with the disk (31) by molding, a flange (32) which is formed integrally around the disk (31) by molding, the flange comprising a circular bulge (321) that is received in a circular groove (11) on the container (10);

a recess (34) between the disc (31) and the flange (32) in which is disposed an elastic split ring (35) adapted to increase the elasticity of the enclosure and prevent the enclosure from deforming when pressed;

a central protective barrel (33) integrally formed with the disk (31) by molding, and wherein a motor (40) is provided in the protective barrel 33 and a rotating member (41) is provided on the motor (40).

4. An ornament having a liquid therein according to claim 3, wherein on said barrel (33) is a supporting disc (50), from which extends upward a central cylinder (51) which fixes a central shaft and a water-agitating member (42) is rotatably fit over the shaft; each of the rotating member (41) and the water-agitating member (42) has a magnet (411, 421) atoning or repelling each other, so that said rotating member (41) rotates when the motor (40) operates and in turn drives the water-agitating member (42) to rotate.

5. An ornament having a liquid therein according to claim 4, further including;

a cover (70) on the cylinder (51), said cover (70) includes an inlet (71) and an outlet (72) for drawing and jetting water respectively.

6. An ornament having a liquid therein according to claim 3, wherein:

in the base (20) there is provided a power source and integrated circuits for providing and controlling the decorative effect.

7. An ornament having a liquid therein according to claim 6, wherein:

on each side of the enclosure disc (30) there is provided two completely enclosed metal terminals for electrically connecting with the power source and a light source.

8. An ornament having a liquid therein according to claim 3, wherein:

a light source (60) is provided in the liquid of the container.

9. An ornament having a liquid therein according to claim 3, wherein:

said enclosure (30) is made of transparent material.

10. An ornament having a liquid therein according to claim 3, wherein:

a light source (60) is provided in the base (20).

11. An ornament having a liquid therein according to claim 3, wherein:

said enclosure (30) is made of rubber material by molding.

* * * * *